US005476600A

United States Patent [19]

Witte

[11] Patent Number: 5,476,600

[45] Date of Patent: Dec. 19, 1995

[54] CONTINUOUS GREASE PROCESS

[75] Inventor: Arnold C. Witte, Port Neches, Tex.

[73] Assignee: Texaco Inc., White Plains, N.Y.

[21] Appl. No.: 264,882

[22] Filed: Jun. 24, 1994

[51] Int. Cl.[6] ..... C10M 117/00

[52] U.S. Cl. ..... 252/38; 252/39; 252/41

[58] Field of Search ..... 252/38

[56] References Cited

U.S. PATENT DOCUMENTS 4,297,227 10/1981 Witte et al. ..... 252/18

4,392,967 7/1983 Alexander ..... 252/39

4,444,669 4/1984 Wittse, Jr. et al. ..... 252/18

5,190,678 3/1993 Swartz et al. ..... 252/18

5,200,098 4/1993 Dumdum et al. ..... 252/18

*Primary Examiner*—Ellen M. McAvoy

*Attorney, Agent, or Firm*—James L. Bailey; Kenneth R. Priem; Richard A. Morgan

[57] ABSTRACT

An improvement has been found in a continuous grease process. A saponification reaction product is continuously recycled through both a shear valve and a heat exchanger to produce a dehydrated grease of uniform consistency and temperature. Both recycle loops are controlled by means of a single shear valve.

6 Claims, 1 Drawing Sheet

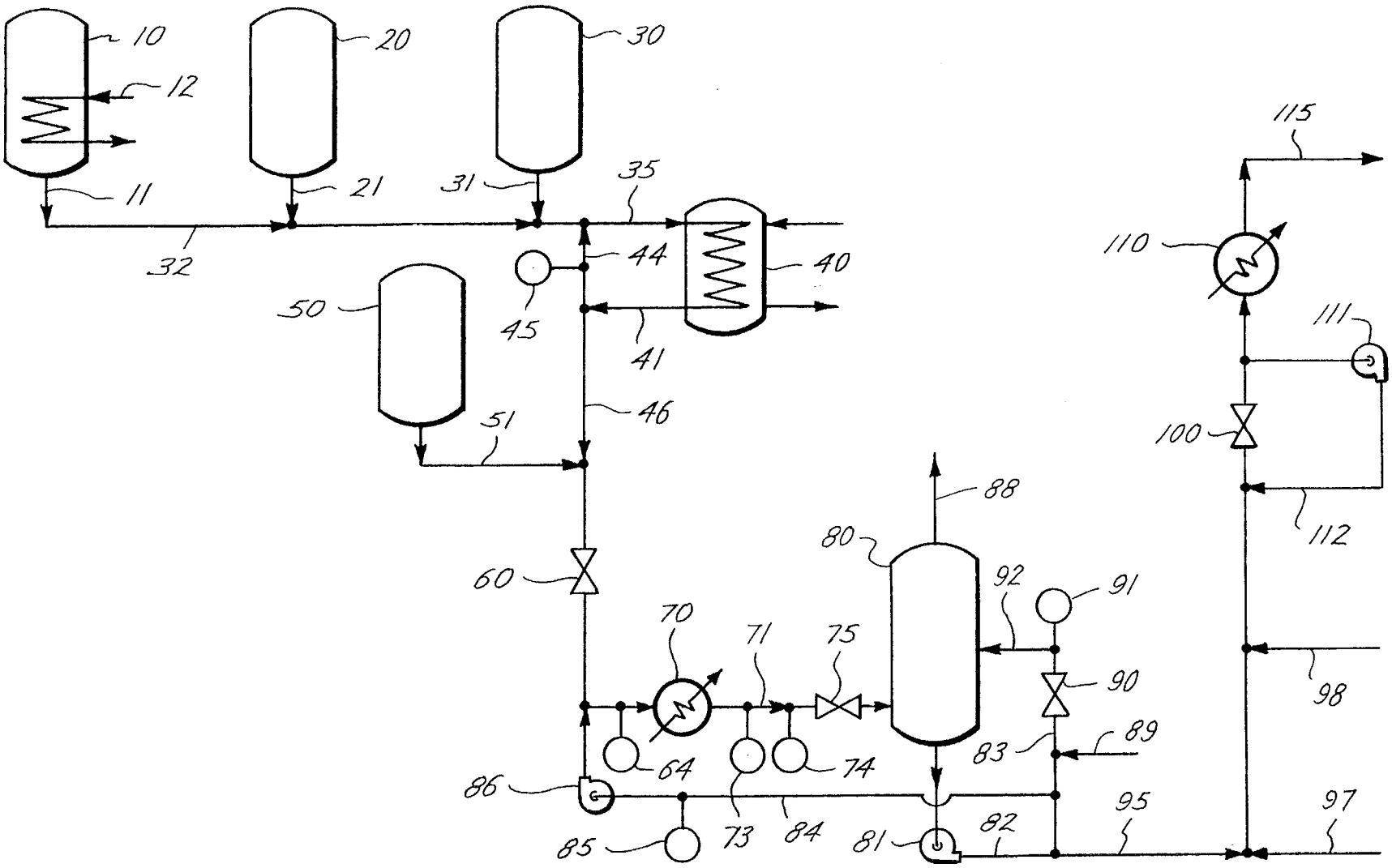
10
11
12
20
21
30
31
32
35
40
41
44
45
46
50
51
60
64
70
71
73
74
75
80
81
82
83
84
85
86
88
89
90
91
92
95
97
98
100
110
111
112
115

CONTINUOUS GREASE PROCESS

BACKGROUND OF THE INVENTION

1. Field of the Invention

The invention is a continuous process for manufacturing soap thickened grease compositions.

2. Description of the Related Art

A lithium complex grease comprises lithium soaps of hydroxy monocarboxylic fatty acids and dicarboxylic fatty acids employed to thicken a lubricating grade oil. A continuous grease process comprises a continuous saponification step followed by a continuous dehydration step. Addition of a lubricating oil to the lithium soap to form the grease composition followed by shearing to disperse the soap evenly throughout the lubricating oil are carried out continuously.

U.S. Pat. No. 4,297,227 to A. C. Witte, Jr. et al. discloses a process for manufacturing a soap thickened grease composition. According to the process a water-soluble additive is admixed with the saponification reaction product. The hot admixture is then passed through pressure reducing means and flash vaporized to remove substantially all the water present.

U.S. Pat. No. 4,444,669 to A. C. Witte, Jr. et al. discloses a process for preparing a high dropping point lithium complex grease. The mole ratio of $C_2$ to $C_{12}$ dicarboxylic acids and $C_{12}$ to $C_{24}$ hydroxy fatty acids is controlled along with temperature to yield a product having a dropping point above about 400° F. (204° C.).

SUMMARY OF THE INVENTION

Inventors have discovered an improved process for continuously manufacturing a grease product. According to a continuous grease process, a saponifiable material is reacted with an aqueous solution of a metal base in a saponification zone at a saponification reactor temperature and superatmospheric pressure to produce a saponification reaction product comprising soap. The saponification reaction temperature is in the range of about 200° F. (93.3° C.) to 25° F. (13.9° C.) below the soap melting temperature.

The saponification reaction product is first, passed through a pressure reducing means to effect pressure reduction to flash vaporize substantially all the water present. Second, the saponification reaction product is passed through a heat exchange means to heat the saponification reaction product to a dehydration temperature in the range of about 225° C. (107.2° C.) to the soap melting temperature, preferably about the saponification reaction temperature. Third, the saponification reaction product is passed to a dehydration zone to produce a dehydrated reaction product.

Lubricating oil is added to a first portion of the dehydrated reaction product. This first portion is then recycled through a shear valve to condition the soap contained therein.

In the improvement, a second portion of the dehydrated saponification reaction product is recycled through the heat exchange means in a volumetric ratio of total throughput: recycle in the range of 2:1 to 20:1. As a result a more uniform heat distribution is achieved.

BRIEF DESCRIPTION OF THE DRAWING

The drawing is a schematic representation of a continuous process for manufacturing grease incorporating the improvement of the invention.

DETAILED DESCRIPTION OF THE INVENTION

The process of the invention provides an improvement to a continuous process for manufacturing soap thickened greases. Grease compositions within the scope of the invention comprise the reaction product of a saponifiable material with a metal base in admixture with lubricating quality oils.

Suitable saponifiable materials for use in preparation of these grease compositions comprise higher fatty acids containing from about 12 to 32 carbon atoms per molecule and hydroxy substituted higher fatty acids, their glycerides and other esters and mixtures thereof. Saponifiable materials include higher fatty acids in admixture with lower fatty acids, such as fatty acids containing from 1 to about 6 carbon atoms per molecule, their glycerides and other esters. Such lower fatty acids are employed in amounts giving a mole ratio of lower fatty acid to higher fatty acid of about 1:1 to about 20:1. Also, intermediate molecular weight fatty acids may be employed in admixture with the higher fatty acids in amounts varying generally within the mole ratio of intermediate to higher fatty acid below about 1:1.

Metal bases employed to saponify the saponifiable materials may be a hydroxide or other suitable basic reactable compound of any of the metals used in the art as the metal component of soaps employed in the manufacture of lubricating greases. These include, for example, the oxides, hydroxides, and carbonates of sodium, lithium, potassium, calcium, barium, magnesium, zinc, cobalt, manganese, aluminum and lead. The preferred greases prepared by the method of this invention are those wherein the soap thickener is an alkali metal or alkaline earth metal soap, or a mixture of two or more soaps of these metals.

The oil employed in greases to be manufactured according to the process of the present invention may be selected from oils having lubricating characteristics, including the conventional mineral lubricating oils, synthetic oils obtained by various refining processes such as cracking and polymerization, and other synthetic oleaginous compounds such as high molecular weight ethers and esters. The dicarboxylic acid esters, such as di-2-ethylhexyl sebacate, di(sec-amyl) sebacate, di-2-ethylhexyl azelate, diisoctyl adipate, etc. comprise a particularly suitable class of synthetic oils and may be employed either as the sole oleaginous component of the grease or in combination with other synthetic oils or mineral oils. Suitable mineral oils for use in these greases are those having viscosities in the range from about 100 to about 8000 seconds, Saybolt Universal at 100° F. (37.8° C.), which may be blends of low and high viscosity naphthenic or paraffinic oils, or blends of two or more oils of these different types.

In the production of greases from synthetic oils which may hydrolyze under the saponification conditions, the saponification reaction is preferably carried out in the absence of any lubricating oil or in the presence of an oil which is substantially inert under the saponification conditions, such as mineral oil and the synthetic oil added at later stages of the grease making process.

Grease making comprises saponification, dehydration and soap conditioning steps carried out in a continuous manner with recycling of the grease mixture through a shear valve during the soap conditioning step. Water-soluble additives may be added as aqueous liquid solutions to the saponification reaction product. The water of solution is removed during the dehydration step in a manner to produce additive particles of less than 10 microns, preferably less than 5 microns size dispersed throughout the grease composition.

The process also may comprise a cooling and finishing step, which may be carried out by addition of lubricating oil at a lower temperature than the grease mixture or by flowing the grease mixture through a cooler following the soap conditioning step.

In carrying out the process, the saponification zone is maintained at an elevated temperature for enhancing the saponification reaction, and at an elevated pressure at least sufficient to maintain water present in the liquid phase, and the dehydration zone is operated at an elevated temperature, but preferably 200° F. (93.3° C.), and under a substantially lower pressure than the saponification zone such that substantially all water present is flashed when the saponification reaction product enters the dehydration zone, such that the water-soluble additive is distributed throughout the saponification product as particles of less than 10 micron, and preferably less than 5 micron size. Any remaining water is removed during recycling of the grease mixture through the conditioning step shear valve; which subjects the grease mixture to a continuous flashing operation by pressure release of the recycle stream through the shear valve. Such recycling, for the soap conditioning step, if preferably carried out at a rapid rate, such that the grease mixture is subjected to multiple passes through the high pressure drop shear valve during the residence time of the grease mixture within the dehydration zone.

Cooling of the grease mixture after the conditioning step is preferably carried out with the addition of lubricating oil at a substantially lower temperature than the grease mixture and very advantageously in some cases with recycling of the grease mixture through a cooler. The process is also carried out in some cases with additional conditioning of the soap by recycling the grease mixture through a second shearing means during or after cooling.

The drawing is a schematic representation of a continuous grease plant for carrying out the process of the present invention. For the sake of clarity many elements, such as valves, piping, instrumentation, pumps, etc., commonly employed in such process plants have been omitted from the drawing.

In the drawing, a saponifiable material maintained at a temperature above the melting point in vessel 10 by heat supplied from heating means 12. Vessel 20 contains lubricating oil. Vessel 30 contains an aqueous solution or oil slurry of a metal base.

Saponifiable material from vessel 10 flows at a controlled rate via line 11 into line 32. Lubricating oil, which may be preheated, flows from vessel 20 at a controlled rate to provide at least about 10% by weight in the grease mixture entering dehydration vessel 80 via line 21 into line 32. Metal base from vessel 30 flows at a controlled rate via line 31 into line 32. From line 32, the saponifiable material, lubricating oil, and metal base flow into the inlet 35 of saponification zone reactor 40. When the saponification reaction is carried out employing a slurry of metal base in oil, it is desirable to introduce a small amount of water or steam into saponification zone 40 for promoting the saponification reaction. The mixture in saponification zone 40 is maintained under superatmospheric pressure sufficient to maintain water present in the liquid phase, and at elevated temperature sufficient to obtain a rapid reaction between the metal base and the saponifiable material. Reaction conditions include pressure in the range of about 10 psig to 300 psig, and temperatures of about 180° F. (82.2° C.) up to above the melting point of the soap formed in the reaction. The melting point of the soap is generally in the range of 450° F. (232.2° C.) to 500° F. (260.0° C.). Preferably, pressures are selected in the range of from 50 psig to 200 psig and temperatures in the range of about 200° F. (93.3° C.) to 350° F. (176.6° C). This temperature is measured by temperature indicator 45 in recycle line 44.

The reactant mixture is passed through the saponification zone in reactor 40 at a velocity which is sufficient to maintain turbulent flow within the tubular reactor. Preferably, the reactant mixture flow velocity is sufficient for producing highly turbulent flow, i.e., Reynolds numbers in the range of about 4000 to 100,000. Flow rates required for obtaining this turbulent flow are generally in the range of from about 0.6 cubic feet per minute to 12 cubic feet per minute of reaction mixture per square inch of reactor cross-section for obtaining high flow rates of reactant mixture through the saponification zone in reactor 40. Reactor effluent from saponification zone outlet 41, may be recycled via recycle line 44 to saponification zone inlet 35. In this manner, a high flow rate of reaction mixture through the saponification zone may be maintained independently of the charge rate to reactor 40, and turbulent flow can be maintained while providing a long residence time as may be required for substantially complete reaction. A typical recycle rate employed is a recycle to charge ratio of about 10:1 to 100:1, through ratios as low as 1:1 and as high as 200:1 are known in the art.

A saponification reaction product is withdrawn from line 41 via line 46 at about the saponification reaction temperature and pressure. If required, an aqueous solution of water-soluble additives, contained in vessel 50 is added via line 51 to the saponification reaction product in line 46. Temperature of the combined mixture in line 46 is maintained, preferably in the range of about 250° F. (121.1° C.) to 350° F. (176.7° C.), sufficiently high enough that all the water present will vaporize upon pressure reduction below superatmospheric. The temperature should not exceed the melting point of the soap present in the mixture. A temperature of about 350° F. (176.7° C.) has provided good results and for that reason is preferred.

The water-soluble additives include materials which contribute anticorrosive, extreme pressure wear, and other desirable properties to the finished grease. These additives include such inorganic compounds such as sodium nitrite, cadmium acetate, sodium metaborate, sodium sulfide, zinc borate, boric acid, and mixtures thereof. These water-soluble additives are passed at a controlled flow rate via line 51 to line 46 providing amounts ranging from about 0.5 to 2 percent by weight in the final grease product.

The hot combined mixture of saponification reactor product and aqueous additive solution passes through pressure reducing valve 60 into heater 70. The pressure drop across valve 60 is sufficient to flash vaporize a substantial portion of the water present in the combined mixture. Flash vaporization causes the temperature to drop. This temperature is measured on temperature indicator 64. Additional heating is provided in heat exchanger 70 to restore the temperature of the combined mixture to at least about 225° F. (107.2° C.), and preferably about 380° F. (193.3° C.) to ensure all water present is in the vapor state. This temperature is measured by temperature indicator 73. From heat exchanger 70, the combined mixture and water vapor flow via line 71 and shear valve 75 into dehydration vessel 80, containing a dehydration zone.

Dehydration vessel 80 comprises a vertically cylindrical vessel having a volume sufficient to provide for the mixture of saponification reaction mixture and water vapor residence time of about 1 minute to 20 minutes. Dehydration vessel 80 may be equipped with a jacket for providing additional heating or cooling, as the process may require. The hydration zone in dehydration vessel 80 is maintained at a pressure up to about atmospheric, and preferably in the vacuum range, under conditions wherein substantially all of the water present in the combined mixture flash vaporizes upon passing through valve 60. Vaporized water is withdrawn from dehydration vessel 80 via vent 88.

The saponification reaction product is maintained in the dehydration zone at a temperature at least 225° F. (107.2° C.), and ordinarily at least about 380° F. (193.3° C.) but below the melting point of the soap. Pressure is at about 5 to 25 inches of mercury.

The grease mixture is recycled continuously through heat exchanger 70 and through shear valve 90 as follows. The grease mixture is withdrawn from dehydration vessel 80 and divided into two portions. A first portion is passed via line 83 to shear valve 90, pressure indicator 91 and line 92 back to dehydration vessel 80. Shear valve 90 is suitably a gate valve, set to provide a pressure drop of about 10 to 200 psi, preferably 25 to 125 psi. Recycling is carried out by means of pump 81 at a rapid rate so that the turnover rate in dehydration vessel 80 is at least equivalent to the average volume of grease therein per minute, and sufficient to provide at least about 5 batch turnovers, preferably at least 10 batch turnovers, during the average residence time of the grease mixture within dehydration vessel 80.

A second portion of the grease mixture is passed from pump 81 to line 82, line 83 and line 84, through flow rate indicator 85, pump 86, heat exchanger 70, line 71 and shear valve 75, back to dehydration vessel 80. This second portion of grease mixture is taken upstream of shear valve 90 in an amount to provide a volumetric ratio of total saponification reaction product through the heat exchanger 70 to recycle of 2:1 to 20:1. Flow rate of total saponification reaction product is measured by flow rate indicator 74. Flow rate of recycled grease is measured by flow rate indicator 85.

In a preferred method of carrying out the invention the volumetric ratio of total throughput through heat exchanger 70 and line 71 to recycle through line 83 is selected in the range of 2:1 to 20:1 in an amount proportional to the difference between the dehydration temperature measured on temperature indicator 91 and the saponification reaction temperature measured on temperature indicator 45.

The ratio of total flow rate to recycle rate through heat exchanger 70 is controlled by adjusting shear valve 75 and shear valve 90. This is accomplished by withdrawing the second portion of grease from line 82 upstream of shear valve 90. In general, it has been found that the volumetric ratio of first portion: second portion should be at least 2:1, and preferably 2:1 to 4:1 to provide adequate circulation in the circuit.

The recycle through shear valve 90 and the recycle and heating through line 84, heat exchanger 70 and line 71 provides improved heat transfer for essentially complete dehydration of the grease product. Preferably, the recycle rate and average residence time in dehydration vessel 80 are sufficient to provide a soap conditioning period of at least 5 minutes.

Lubricating oil may also be added, via line 89 into line 83 wherein the grease is undergoing conditioning. The addition of oil at this point in the process aids recycle when a heavy grease mixture is being circulated. Lubricating oil is added in an amount to provide the grease mixture in dehydration vessel 80 at least about 25% by weight lubricating oil, preferably at least about 40% by weight of lubricating oil.

An essentially dehydrated grease mixture is withdrawn from the recycle grease in line 82 via line 95. Additional lubricating oil may be added as required to the dehydrated grease mixture via line 97. The additional lubricating oil added to the grease mixture in line 95 may amount to as much as 90% by weight of the total lubricating oil in the finished grease. It is ordinarily preferable to carry out the grease manufacture with about 20% to 80% by weight of the total lubricating oil in the grease product add at this point at a temperature of at least 100° F. (55.6° C.) below the temperature of the grease mixture in line 95. Additives are optionally added to the grease mixture via line 98.

The grease mixture from line 95 passes through shear valve 100, which may be operated with a substantial pressure drop. In cases where additional cooling is desirable, the grease may then be passed through cooler 110, and the grease mixture may be recycled via pump 111 in line 112 for multiple pass through shear valve 100. A grease product is withdrawn via line 115 for packaging.

While particular embodiments of the invention have been described, it will be understood, of course, that the invention is not limited thereto since many modifications may be made, and it is, therefore, contemplated to cover by the appended claims any such modification as fall within the true spirit and scope of the invention.

What is claimed is:

1. In a continuous grease manufacturing process wherein a saponifiable material is reacted with an aqueous solution of a metal base in a saponification zone at a saponification reaction temperature and superatmospheric pressure to produce a saponification reaction product comprising soap, the saponification reaction temperature in a range of about 200° F. (93.3° C.) to 25° F. (13.9° C.) below the soap melting temperature wherein said saponification reaction product is first (i) passed through a pressure reducing means to effect pressure reduction to flash vaporize substantially all the water present in said saponification reaction product; (ii) passed through a heat exchange means to heat the saponification reaction product to a dehydration temperature of at least 225° F. (107.2° C.) to the soap melting temperature; and then third (iii) passed to a dehydration zone to produce a dehydrated saponification reaction product, and wherein a first portion of said dehydrated saponification reaction product is recycled through a shear valve for conditioning the soap contained therein, and wherein lubricating oil is added to said recycled dehydrated saponification reaction product for producing a grease product, the improvement which comprises:

recycling a second portion of the dehydrated saponification reaction product through the heat exchange means in a volumetric ratio of total throughput:recycle in the range of 2:1 to 20:1.

2. The process of claim 1 wherein the ratio of total throughput: recycle is selected in an amount proportional to the difference between the dehydration temperature and the saponification reaction temperature.

3. The process of claim 1 wherein said the second portion of the dehydrated saponification reaction product is taken upstream of the shear valve.

4. The process of claim 1 wherein the volumetric ratio of the first portion: second portion of the dehydrated saponification reaction product is at least 2:1.

5. The process of claim 1 wherein the volumetric ratio of the first portion:second portion of the dehydrated saponification reaction product is 2:1 to 4:1.

6. The process of claim 1 wherein the dehydration temperature is about the same as the saponification reaction temperature.

* * * * *